US009522754B2

(12) United States Patent
Steppeler

(10) Patent No.: US 9,522,754 B2
(45) Date of Patent: Dec. 20, 2016

(54) APPARATUS AND METHOD FOR PROCESSING STACKS OF BAGS

(71) Applicant: HAVER & BOECKER OHG, Oelde (DE)

(72) Inventor: Bernd Steppeler, Dellbrueck (DE)

(73) Assignee: HAVER & BOECKER OHG, Oelde (DE)

( * ) Notice: Subject to any disclaimer, the term of this patent is extended or adjusted under 35 U.S.C. 154(b) by 0 days.

(21) Appl. No.: 14/430,474

(22) PCT Filed: Sep. 20, 2013

(86) PCT No.: PCT/EP2013/002837

§ 371 (c)(1),
(2) Date: Mar. 23, 2015

(87) PCT Pub. No.: WO2014/044398

PCT Pub. Date: Mar. 27, 2014

(65) Prior Publication Data

US 2015/0284119 A1 Oct. 8, 2015

(30) Foreign Application Priority Data

Sep. 24, 2012 (DE) ..... 10 2012 018 769

(51) Int. Cl.
*B65B 43/18* (2006.01)
*B65B 43/30* (2006.01)
*B65H 9/10* (2006.01)

(52) U.S. Cl.
CPC ..... *B65B 43/18* (2013.01); *B65B 43/30* (2013.01); *B65H 9/101* (2013.01); *B65H 2511/12* (2013.01)

(58) Field of Classification Search
CPC ..... B65H 9/101; B65H 2511/12; B65B 43/30; B65B 43/18
See application file for complete search history.

(56) References Cited

U.S. PATENT DOCUMENTS 2,986,262 A 5/1961 Powers
4,537,015 A 8/1985 Inglett, Jr. et al.
5,110,113 A * 5/1992 Kanaya ..... G03G 15/234 271/163
5,916,079 A 6/1999 Haring et al.
(Continued)

FOREIGN PATENT DOCUMENTS

DE EP 0344363 A1 * 12/1989 ..... B65B 43/30
EP 2455288 5/2012

*Primary Examiner* — Luis A Gonzalez
(74) *Attorney, Agent, or Firm* — Greer, Burns & Crain, Ltd.

(57) ABSTRACT

A processing device for processing at least one stack of bags including a plurality of bags, wherein at least one stacking device is provided on which the stack of bags can be arranged in a base position, wherein the bags in the stack of bags have a bag length and a bag width, including providing at least one centering device having at least two centering units disposed opposite one another and disposed so that a driving device can move them relative to one another, towards one another and away from one another, and that the centering unit provided on a first side is at least temporarily coupled with a return side of at least one continuous belt and wherein the centering unit provided on a second side is at least temporarily coupled with the carrying side of at least one continuous belt.

16 Claims, 10 Drawing Sheets

(56) References Cited

U.S. PATENT DOCUMENTS

| | | | | |
|---|---|---|---|---|
| 6,510,670 | B1 | 1/2003 | Janhonen | |
| 6,698,573 | B2 * | 3/2004 | Gienger | B23Q 3/183 198/345.1 |
| 2008/0141632 | A1 | 6/2008 | Monti | |
| 2014/0223859 | A1 | 8/2014 | Schuette | |

* cited by examiner

APPARATUS AND METHOD FOR PROCESSING STACKS OF BAGS

BACKGROUND

The present invention relates to an apparatus and a method for processing stacks of bags and in particular a packaging machine or an apparatus or a device assigned to a packaging machine. The apparatus may serve to center the bags in a stack of bags. It is further possible for the apparatus to serve to separate the bags from a stack of bags and moreover also to open the separated bags, append them to a filling spout, optionally to fill them e.g. with bulk material, to close them and convey them off.

Document DE 10 2011 113 879.3 describes a processing device and a method for processing stacks of bags wherein the processing device separates the bags and subsequently appends them to a filling spout of a packaging machine were they are filled with bulk material. This apparatus and the method described therein basically function reliably. However, it has been found that for example comparatively long bags showing a relatively narrow width tend to slip and slide on the stack of bags. Even if the bag shows just minimal lateral movement the bag may be placed onto the filling spout at an angle or offset so that the processing speed decreases or even intervention in the operation is required.

It is therefore the object of the present invention to provide a processing device and a method for processing stacks of bags which allow to increase reliability.

SUMMARY

A processing device according to the invention serves to process at least one stack of bags comprising a plurality of bags. At least one stacking device is provided on which the stack of bags can be placed in a base position. The bags in the stack of bags show a bag length and a bag width. At least one centering device is provided that includes at least two centering units disposed opposite one another and which are disposed so that a driving device can move them relative to one another, toward one another and away from one another.

The processing device according to the invention has many advantages. The processing device according to the invention allows increased reliability when processing stacks of bags. The centering device allows to laterally center the bags in a stack of bags. The fact that the centering units are disposed opposite one another and a driving device allows their relative movement toward one another or away from one another allows to reliably center the bags in a stack of bags.

In case that when positioning a stack of bags on the stacking device in the base position some or several bags come to be—even slightly—offset, the centering device then reliably centers these bags together with, and/or within, the stack of bags. Thus, a precisely defined position of the bags is ensured prior to further processing.

It is possible and also preferred although not required for the centering units disposed opposite to be directly opposite one another. It is also possible for the centering units disposed on different sides to be staggered in the longitudinal direction. It is possible for the quantity of centering units on one of the sides to differ from the quantity of centering units on the other side. For example 2, 3, 4 or more centering units may be provided in the longitudinal direction while the other side shows e.g. one single centering unit or one less than, or else only half the number of, the other side, or any desired other quantity of centering units, or else one continuous centering strip. What is essential is to enable centering between the opposite centering units.

In the simplest of cases one centering unit only is provided on each side. Or else it is possible to provide two centering units on one side and one only on the other side.

In a preferred specific embodiment the driving device comprises at least one belt. Preferably at least one centering unit may be coupled to the belt at least temporarily. A driving device provided with at least one belt offers many advantages. Preferably the belt is a continuous belt and it is redirected for example over two or more pulleys. This configuration allows a driving unit or driving device to drive the belt by means of a pulley. Or else it is possible for a linear drive to directly act on the carrying side or return side of the belt, driving the belt by linear movement.

In particularly preferred specific embodiments at least part of the two centering units disposed on opposite sides is at least temporarily coupled with at least one belt of the driving device. A driving device having for example two or more belts arranged in particular in parallel allows to couple a centering unit with a first belt at least temporarily and to couple a second centering unit with a second belt at least temporarily. In the case of not overly huge processing devices it is in particular preferred to provide just a small quantity of belts and in particular one single belt to which the centering units on opposite sides can be coupled at least temporarily.

Particularly preferably at least one centering unit provided on a first side can be coupled at least temporarily with the return side of at least one continuous belt. It is particularly preferred to have at least one centering unit provided on a second side at least temporarily coupled with the carrying side of at least one continuous belt.

These configurations offer considerable advantages. The fact that the carrying side of a continuous belt driven in one direction moves in one of the directions while the return side moves in opposite sense in the other direction, allows in a very simple way to obtain opposite-sense movement of the centering units provided on both sides. When a centering unit is coupled on one side with the return side and another centering unit is coupled on the other side with the carrying side, then movement of the belt in a first direction of rotation decreases the distance between the centering units while rotation in the other direction increases the distance between the two centering units.

This principle can be utilized advantageously since an adjustable or controlled displacement of the belt allows to adjust the distance between the centering units. The distance may be adjusted by way of the size of the angle of rotation or the size of the linear movement of the belt.

It is particularly preferred for the bottom surface of the stacking device to be larger than the surface of the stack of bags. A width of the stacking device is in particular larger than the width of the bags in the stack of bags and the length of the stacking device is likewise larger than the length of the bags in the stack of bags. This is to ensure that the stack of bags is always completely supported on the stacking device. There is no lateral overhang of the stack of bags.

In all the configurations it is particularly preferred for at least one centering unit to be configured as, or comprise, a centering finger. It is also possible and preferred for at least one centering unit to include or comprise at least one tine or centering tine.

Particularly preferably at least one centering unit is at least temporarily displaceably disposed in a groove of the stacking device. It is for example possible and preferred for at least one centering unit to protrude upwardly from below through the stacking device. On the stacking device, which may for example show a plate on the surface, the stack of bags is disposed which can be centered or positioned on the stacking device as desired due to the centering units passing through from beneath.

It is also possible for at least one centering unit to extend at least temporarily from above into the groove in the stacking device or downwardly from above through the groove in the stacking device.

Particularly preferably at least one centering unit is disposed in a first position entirely beneath the stacking device or at least beneath a plate of the stacking device. This configuration allows ease of positioning the stack of bags on the stacking device since in particular the centering units disposed on one side can be placed in the first position when a stack of bags is intended to be positioned on the stacking device. The fact that the centering units are displaced to the first position prior to positioning the stack of bags on the feeding side of the stack of bags to the stacking device, they do not project upwardly while positioning the stack of bags on the stacking device and so do not impede positioning the stack of bags in the base position. This variant provides for the bags to be centered within the stack of bags. Movement of the entire stack of bags during centering is not required. Therefore the term of centering in the sense of this application is also intended to mean precise positioning.

Preferably a second position of the centering unit is provided in which the centering unit rises, and in particular pivots, upwardly from beneath through the groove.

Particularly preferably at least one third position is provided in which the centering unit extends through the groove beyond the top surface of the plate of the stacking device. In this position the stack of bags can subsequently be positioned.

In all the configurations it is preferred to provide at least one adjustable and in particular exactly one adjustable stopper defining a bag width and thus in particular limiting the distance which the centering units travel.

The adjustable stopper may in particular be displaceable. A travel capturing device may be assigned to the adjustable stopper to allow an automatically controlled adjustment of the bag width. A drive may be provided for controlled adjustment of the adjustable stopper which is for example a linear drive or which varies the adjustable stopper in some other way. The adjustable stopper may for example be provided on a rotary spindle. The travel capturing device may measure a traveled distance directly or else it may infer a set distance for example by way of an absolute encoder or other sensory functions.

It is preferred for at least one centering unit to be coupled with the belt through a coupling mechanism.

Such coupling mechanism allows controlled coupling and decoupling of the centering unit with and from the belt.

It is possible and preferred for the coupling mechanism to comprise at least one spring device. A spring mechanism or a spring device allows to decouple the centering unit from the belt for example by separately arresting or separately moving the centering unit. After deactivating the acting forces this spring device automatically establishes a base state without requiring any drive.

Preferably the coupling mechanism comprises at least one coupling unit and at least one movable stopper.

For example if the driving device comprises a cylinder having an extending piston rod it is possible for the piston rod to be fixedly connected with a movable stopper that is displaceably arranged on a sliding guide or the like. Only as the movable stopper with the coupling rod is extended far enough for the coupling unit to engage with the movable stopper will the coupling unit and the movable stopper move further in synchrony.

Such a coupling mechanism allows for example to move a centering unit on one of the sides only after the centering unit on the other side has already traveled part or even a considerable part of the distance. This is advantageous in particular if the centering unit is first disposed beneath the stacking device on the other side and it must first pivot upwardly. Then it is useful for the centering units to only start approaching one another after the centering unit that is firstly provided beneath the stacking device has already pivoted upwardly. This allows to provide a processing device that is smaller on the whole and thus requires reduced space in width.

Preferably the coupling mechanism is therefore set up and configured to establish a coupling between the centering unit and the belt at least in a second position. The coupling mechanism is in particular configured and set up to establish a coupling starting from a second position so that the centering unit and the belt are also coupled in a third position subsequent to the second position.

Preferably the coupling mechanism is configured and set up so that in the first position a coupling between the centering unit and the belt is at least substantially released.

In the alternative both the centering units may be pivotal so that both the centering units are forced to always travel the same distance. It is possible to provide a separate driving unit for displacing the at least one centering unit on one side.

This configuration allows to already displace the centering units to the stopper position on one side before positioning a bag bundle on the stacking device. This is particularly advantageous for bags in a stack of bags that tend to slip sideways in positioning. Positioning the stack of bags immediately abutting a lateral end stopper during processing allows to considerably better prevent single bags or some of the bags from slipping within a stack of bags. This allows considerably higher speeds in placing stacks of bags.

However, when processing e.g. particularly stiff bags or bags allowing easy reorganisation such pre-positioning of the centering units on one side of the stack of bags may be dispensed with. Then both of the centering units may approach the stack of bags from both sides for centering and positioning.

In all the configurations the centering device on the whole may in particular also serve to guide the bags during the further processing of the bags in the stack of bags. To this end in particular at least two centering units are provided on each side to enable good guiding properties in the longitudinal direction.

The processed bags are preferably open-mouth bags having a bag length and an open filling mouth at one end. Preferably at least one marker device is provided. The bag conveying device is in particular suitable and provided for gripping the topmost open-mouth bag off the stack of bags in its base position and to displace it to a take-up position that lies only partially on the stack of bags and in the take-up position.

It is preferred to provide at least one bag conveying device. If a marker device is provided, then at least one mark may be put on the open-mouth bags in the take-up position.

Preferably the bag conveying device grips the topmost open-mouth bag by its open filling mouth. The bag conveying device comprises in particular at least one suction device. The suction device may be retractably disposed at the bag conveying device. A distance of the take-up position from the base position is in particular shorter than half the bag length and preferably shorter than one fourth of the bag length. The bag conveying device is in particular pivotally received at least at one pivot axis that is in particular disposed above the stacking device. The bag conveying device preferably acts at the open filling mouth.

At least one pivot device is provided that is equipped with at least one gripper device. The gripper device of the pivot device is in particular suitable to grasp in a first pivot position the open end of the open-mouth bag in the take-up position. The gripper device of the pivot device is preferably suitable when in a second pivot position to hand over the open-mouth bag to a bag opener and/or to a bag appending device.

Advantageously a pivot axis of the pivot device is suitable for pivoting the open filling mouth of the open-mouth bag to a handover position.

A lifting device is in particular provided for lifting the bag bottom of the topmost open-mouth bag of the stack of bags in the base position. A fixing device may be provided which fixes the stack of bags gripping the bag bottom.

It is preferred to provide at least one product feeder and at least one filling spout for filling the open-mouth bags. At least one closing device is also preferred for closing the open filling mouth of the open-mouth bags. A discharge device may be provided for discharging.

The method according to the invention serves for processing at least one stack of bags comprising a plurality of bags. The stack of bags is disposed in a base position on a stacking device. The bags in the stack of bags show a bag length and a bag width. The stack of bags is centered by way of at least one centering device. The centering device comprises at least two centering units disposed opposite one another. The centering units are disposed so they can move relative to one another, toward one another and away from one another.

The method according to the invention also has many advantages. The method according to the invention allows reliable processing of stacks of bags where the bags can be centered within the stack of bags.

In all the configurations it is preferred to process bags which are open-mouth bags, whose bottom ends are closed and whose top ends have an opening. Or else it is possible to process different types of bags or lengths of tubular sheets. It is in particular also possible according to the invention to center stacks of valve bags.

Further advantages of the present invention can be taken from the exemplary embodiments which will be described below with reference to the enclosed figures.

Although the exemplary embodiments will be described with reference to processing open-mouth bags, it is possible to process valve bags or other types of bags or else sheets, lengths of sheets, or lengths of tubes lying flat or the like.

DETAILED DESCRIPTION

Figure 1:
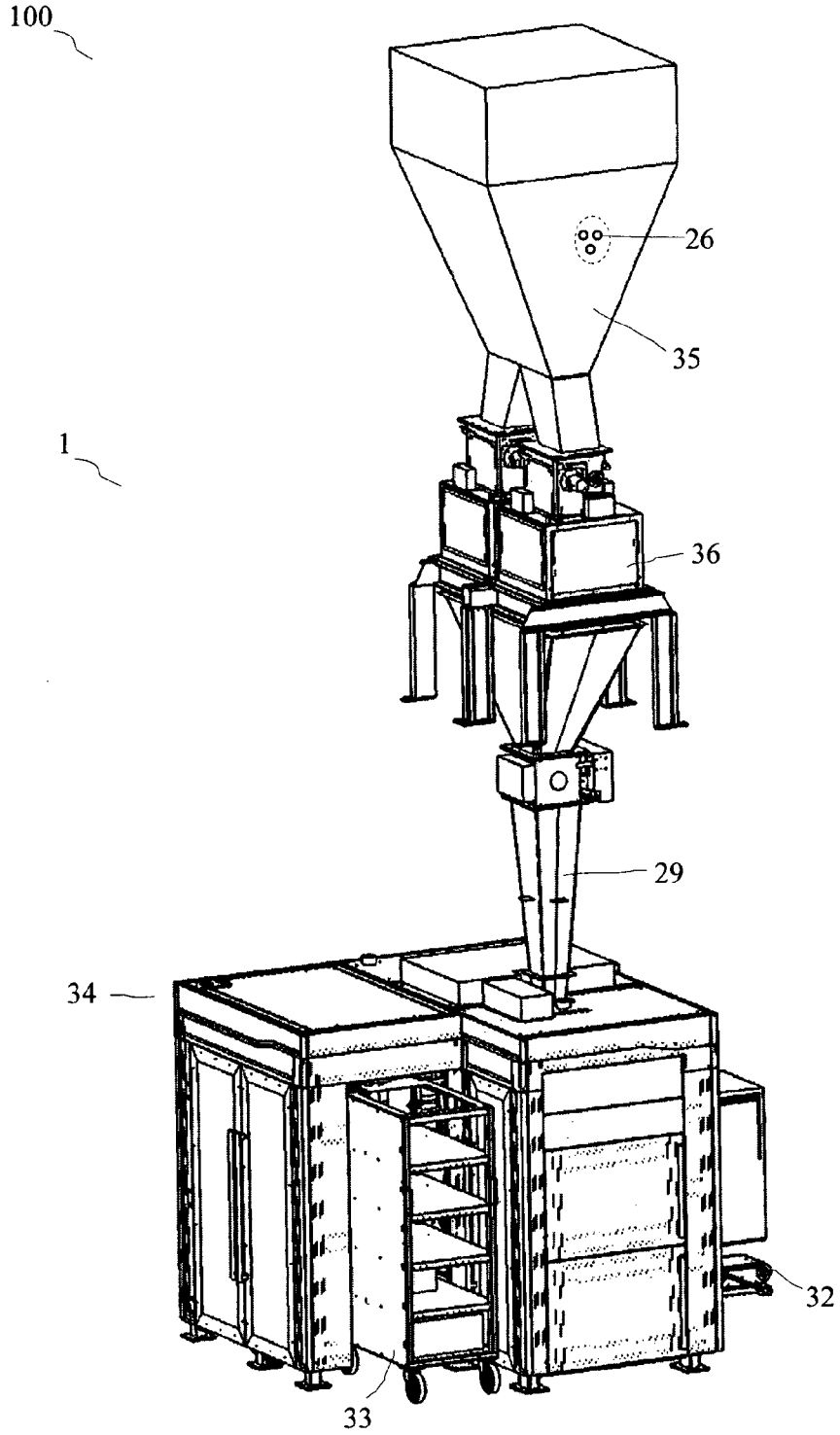
FIG. 1 a schematic perspective of the processing device 1.

FIG. 1 shows a perspective total view of a packaging machine 100 comprising a processing device 1. A silo 35 is provided from which the bulk material 26 for bagging is conveyed to a dosing and weighing device 36. In the exemplary embodiment a weighing system with net-weighing devices is employed where the product 26 for bagging is first collected in a net-weighing device and thereafter filled into the respective open-mouth bag 3. Beneath the dosing device 36 the product feeder 29 is provided that ends in the filling spout 30 not visible in FIG. 1.

A casing 34 encloses the processing device 1. A bag stacking magazine 33 serves to accommodate a number of stacks of bags 2. The filled open-mouth bags 3 are conveyed off via a discharge device 32.

Figure 2:
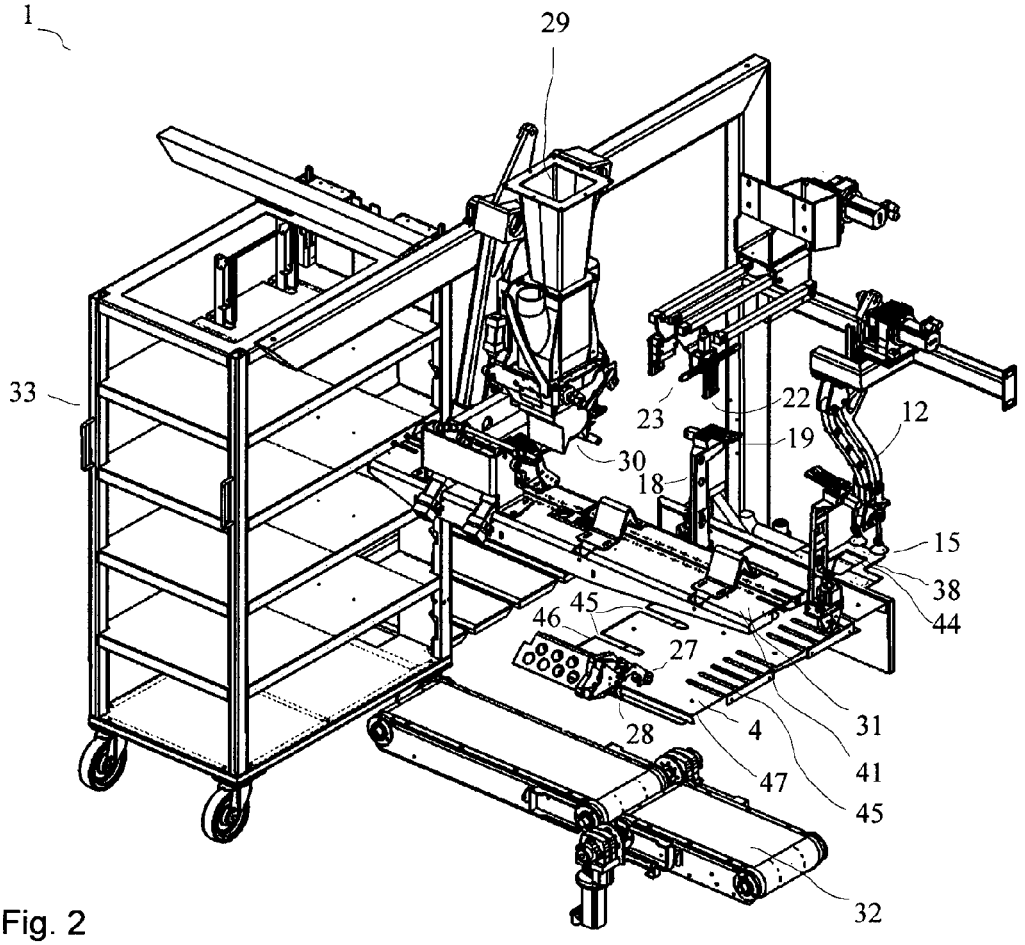
FIG. 2 a simplistic view of the processing device according to FIG. 1 with some components omitted.

FIG. 2 shows a schematic, perspective view of the processing device 1 with the housing and other components omitted.

The product feeder 29 can be identified in the upper region and it opens into the filling spout 30. A stack of bags 2, not shown, is conveyed from the bag stacking magazine 33 to the stacking table 4. The dimensions of the stacking table 4 may approximately correspond to the bag length 6 and the bag width 48. Open-mouth bags 3 variable in bag length 6 can in particular be processed.

A stack of bags 2 is centered by means of a centering device 50 not shown in FIG. 2. This centering device 50 will be described in detail below with reference to the FIGS. 12 to 17. For centering, tines 51 and 52 of the centering device 50 approach the stack of bags from outside through the grooves 45 provided on the two sides 46, 47 of the stacking table 4. The tines 52 are pivoted upwardly from beneath on the side 47 and then moved toward the stack of bags 2, thus centering the stack of bags 2.

The processing device 1 basically works without such a centering device 50. It has been found though that in particular in the case of stacks of bags 2 comprising a comparatively large quantity of open-mouth bags 3 and/or given high processing speeds the open-mouth bags 3 in the stack of bags 2 may slip sideways or else may be gripped at a slight angle. This may adversely affect a highly precise and rapid filling of open-mouth bags 3.

This is reliably prevented by means of a centering device 50 disposed substantially beneath the stacking device 4. Depending on the configuration the tines 51 and 52 of the centering device 50 may be located beneath the stacking device 4 when a new stack of bags 2 is positioned on the stacking device 4 to allow the stack of bags to be pushed onto the stacking device 4.

In particular in the case of long, narrow open-mouth bags 3 the bag bottom may drift sideways while the open-mouth bag 3 is transferred to the take-up position. Guiding by the centering device 50 reliably prevents this.

The rear end of the stacking table 4 is provided with the lifting device 27 and the fixing device 28 for lifting the bottom end of an open-mouth bag 3 disposed on the stacking device 4. Subsequently to lifting the bottom end the remainder of the stack of bags 2 lying beneath is fixed by means of the fixing device 28.

At the front end of the stacking device 4 one can recognize the bag conveying device 12 the lower end of which is provided with a suction device 15 or in other cases, with a friction gear for gripping the open filling mouth 8 of an open-mouth bag 3.

Figure 6:
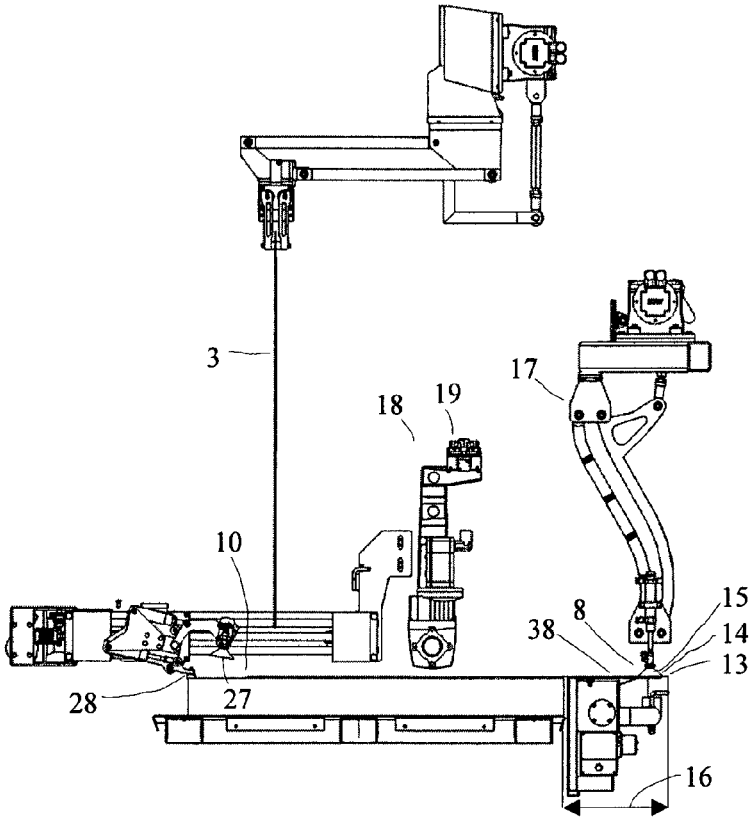
FIG. 6 a fourth view of the processing device according to FIG. 3.

The bag conveying device 12 displaces the open-mouth bag 2 to a front position as it is illustrated in FIG. 6. The filling mouth 8 of the topmost open-mouth bag 13 rests on the supporting device 38. In this position the open filling mouth 8 is accessible from beneath in the marking area 44 visible in FIG. 2. Then the marker device 25 that is provided beneath the supporting device 38 and is therefore not shown in FIG. 2 can put at least one mark 7 on the open-mouth bag 3. A pivot device 18 is equipped with a gripper device 19. The pivot device 18 comprises a pair of pivot arms with a gripper disposed at each of their ends. The pivot device serves to take over a separated open-mouth bag 3 and to transfer it and hand it over to a bag opener 22 and a bag appending device 23 which ultimately append the opened open-mouth bag 3 to the filling spout 30.

After the open-mouth bag 3 has been filled through the filling spout 30 the open filling mouth 8 of an open-mouth bag 3 is conveyed further by means of the top conveying device 41. The top conveying device 41 may comprise a closing device 31 for closing the open-mouth bags 3, or a separate closing device is disposed downstream. The filled open-mouth bag 3 is finally transferred to the discharging belt 32 and discharged.

Figure 2B:
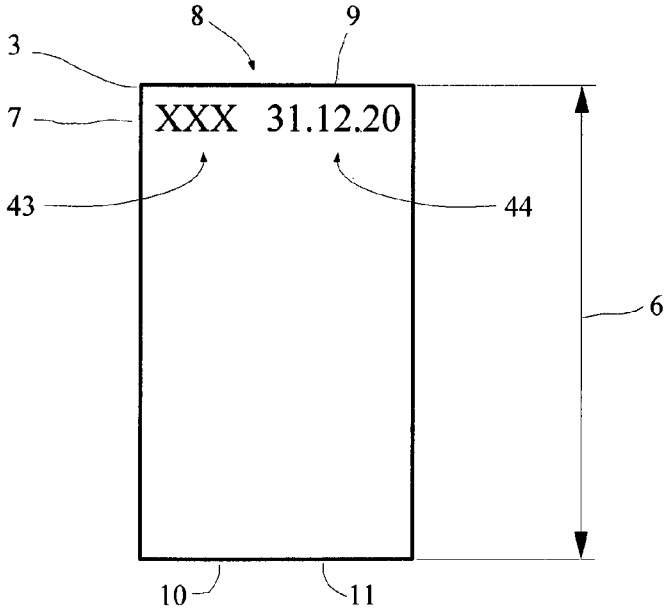
FIG. 2*b* a top view of an open-mouth bag after marking.

FIG. 2*b* illustrates exemplarily a simplistic open-mouth bag 3 in a top view or a view from beneath respectively. The open-mouth bag 3 is provided with a mark 7 made by the marker device 25. The marker device 25 is disposed substantially beneath the stacking device 4 and puts the mark 7 in the marking area 44.

Figure 3:
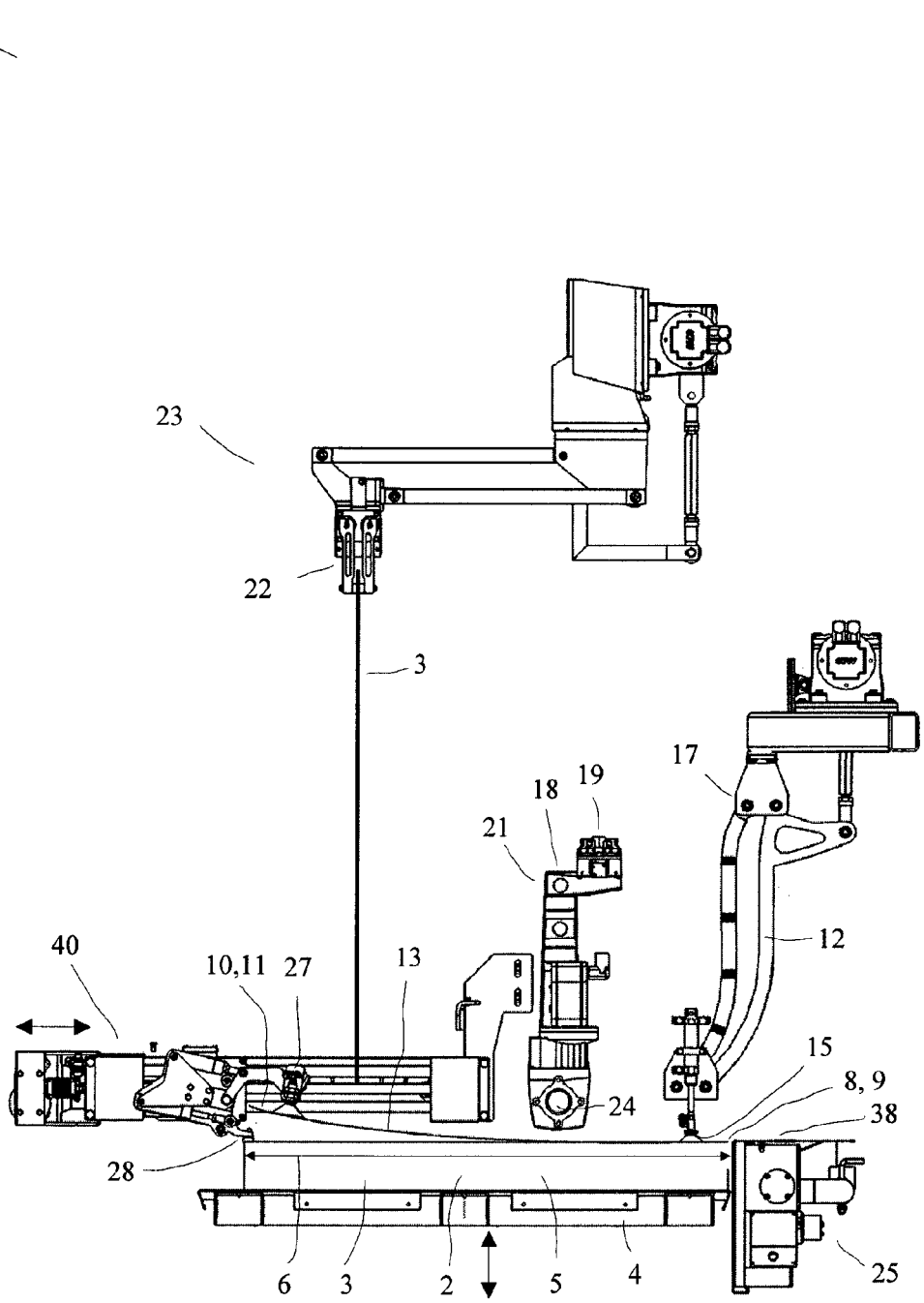
FIG. 3 a side view of parts of the processing device according to FIG. 2 in a side view.

The mark 7 includes a designation 42 ("XXX") and a date 43 ("31.12.20"). The designation 42 may correspond to the trade name or the trademark or else comprise a unique number or the like that preferably unambiguously classifies the contents. The date 43 may indicate or include the best-before date or else for example the bagging date and/or the manufacturing date. It is possible to put multiple designations 42 and/or multiple dates 43 on the open-mouth bag 3. The data may be printed, punched, or e.g. applied by laser. Electronic data transmission to a readable memory is likewise possible. FIG. 3 shows a schematic side view of some of the essential components of the processing device 1. Some of the components and the housing of the processing device have been omitted to facilitate overview and to explain the function.

The processing device 1 comprises a height-adjustable stacking device 4 where a stack of bags 2 has been disposed or is being disposed in the base position 5. The stack of bags 2 comprises a plurality of open-mouth bags 3, each having a specified bag length 6 and bag width 48. The open filling mouths 8 of the open-mouth bags 3 are aligned with the front end of the stacking device 4 while the bag bottom 10 is disposed at the rear end of the stacking device 4, thus forming a stack.

In this exemplary embodiment the open-mouth bags 3 have a bag length 6 corresponding to about the length of the stacking device 4. Longer and in particular shorter open-mouth bags 3 may be used as well. For setting the position of the lifting device 27 and the fixing device 28, an adjusting device 40 is provided that can be displaced in the direction of the bag length 6.

In the position shown in FIG. 3 the lifting device 27 has gripped and lifted the rear end of the open-mouth bag 3 in the vicinity of the bag bottom 10. Subsequently to lifting, the fixing device 28 moves beneath the topmost bag 13 and fixes the remainder of the stack of bags 2 by the bag bottom 10.

The bag conveying device 12 at the front end 9 has an extendible suction device 15 which in the position illustrated in FIG. 3 is extended and has lowered to an area at the open filling mouth 8. In this state the suction device 15 is activated, gripping the front filling mouth 8 of the topmost open-mouth bag 13.

Furthermore a pivot device 18 is provided to take over a separated open-mouth bag 3. The pivot device 18 has a gripper device 19 and is illustrated in FIG. 3 in the second pivot position 21. The pivot device 18 is disposed to pivot about the pivot axis 24. The pivot device 18 serves to take over the topmost open-mouth bag 13 from the take-up position 14 and after the pivot device 18 pivots to the second pivot position 21 it is transferred to the bag opener 22 and the bag appending device 23 shown above the pivot device 18 where an appended open-mouth bag 3 is illustrated in the FIG. 3.

Figure 4:
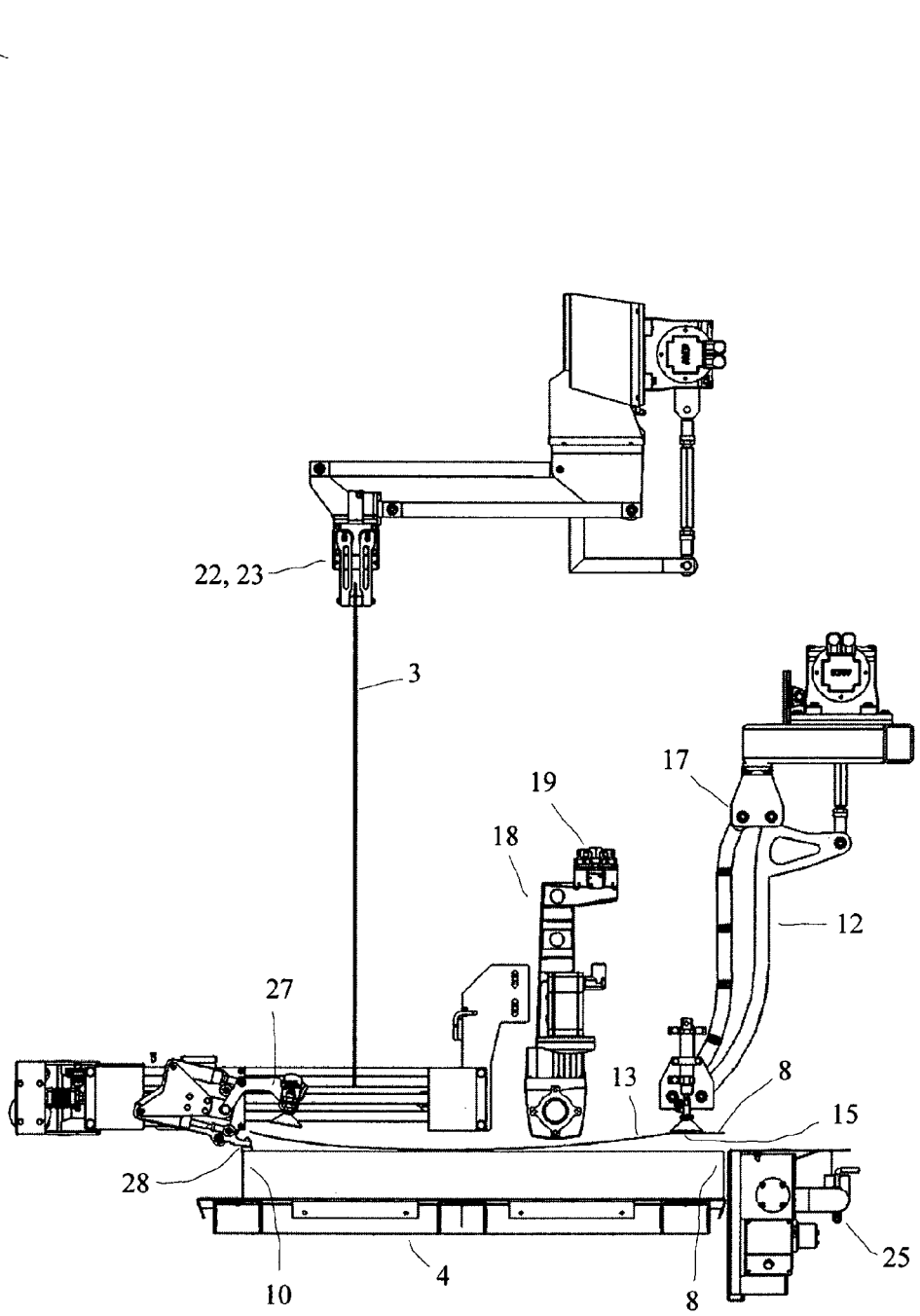
FIG. 4 another view of the processing device according to FIG. 3.

FIG. 4 shows the situation after retracting the suction device 15 at the bag conveying device 12 so that the filling mouth 8 of the topmost open-mouth bag 13 is lifted off the stack of bags 2. At the same time the lifting device 27 at the other end 11 can be deactivated so that the bag bottom 10 falls back down onto the stack of bags 2 that the fixing device 28 retains.

Figure 5:
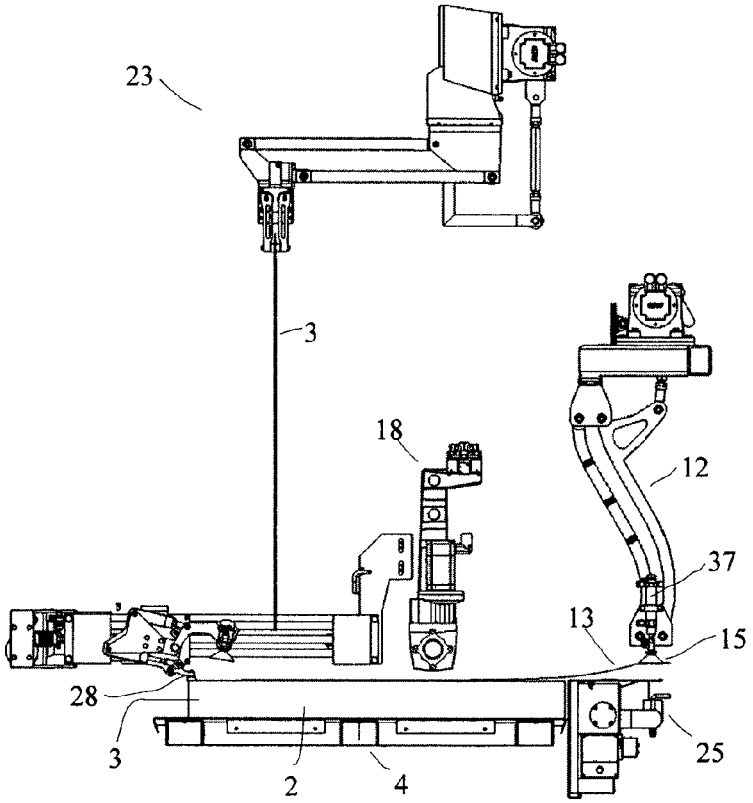
FIG. 5 a third view of the processing device according to FIG. 3.

FIG. 5 shows the position after the bag conveying device 12 has traveled to a front position where the filling mouth 8 of the topmost open-mouth bag 13 lies above the take-up position 14. Accordingly both the open filling mouth 8 and the bag bottom 10 have been displaced forwardly by a distance 16 in the direction of the open filling mouth 8. It is possible to pivot the bag conveying device 12 about one or more pivot axes 17. A different linear movement or a motion resulting in a linear movement is also possible. During the forwardly movement of the bag conveying device 12 the fixing device 28 fixes the rear end of the stack of bags 2 so as to ensure that only one, specifically the topmost, of the open-mouth bags 13 is pulled forward by way of the movement of the bag conveying device 12. This is to realize an efficient separation of the open filling mouth 8 of the open-mouth bag 13.

In transfer from the position shown in FIG. 5 to that shown in FIG. 6 the suction device 15 is displaced downwardly by means of the cylinder device 37 so that the open filling mouth 8 rests on the supporting device 38. In this position the open filling mouth 8 is accessible from beneath at least in part so that the marker device 25 provided beneath the supporting device 38 can apply at least one mark on the open-mouth bag. The marker device may for example include a laser that applies one or more letters or characters to the outer surface of the open-mouth bag 13. It is for example possible to mark or label the open filling mouth of the open-mouth bag 13 indicating the filled product, the batch number, the filling date or the best-before date of foodstuff by embossing or spraying onto the open filling mouth or in some other way.

A marker beam of the marker device may be directed at the bag immediately from beneath or else it may be deflected by mirrors so as to protect the optics from dirt.

In FIG. 6 one can see that the distance 16 by which the topmost open-mouth bag 13 is pulled forward toward its open filling mouth 8 represents only a minor portion of the bag length 6. The distance 16 can be selected to suit the application.

Figure 7:
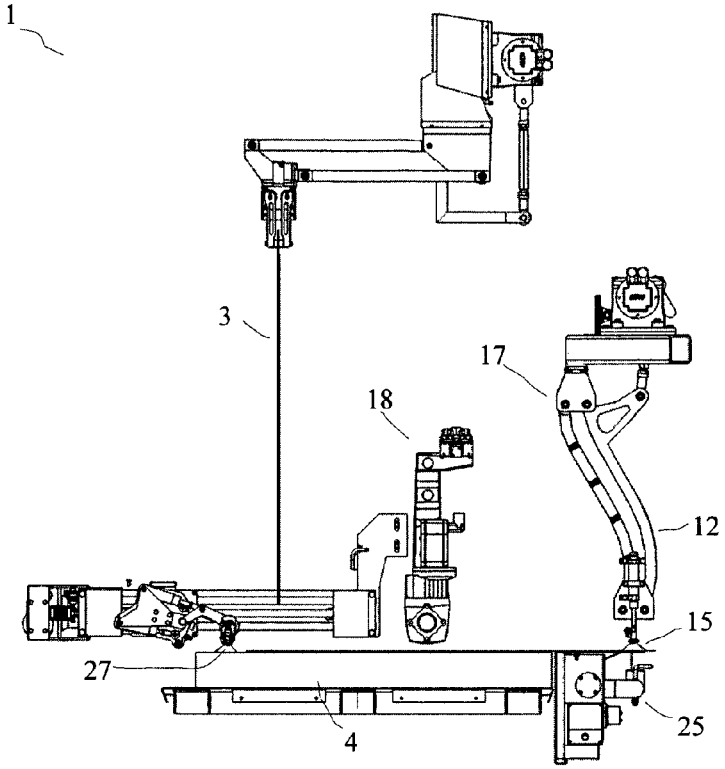
FIG. 7 a fifth view of the processing device according to FIG. 3.

FIG. 7 shows a situation where the lifting device 27 has been lowered back down onto the rear end of the stack of bags 2 for gripping and then lifting the bag bottom 10 of the next open-mouth bag 3.

Figure 8:
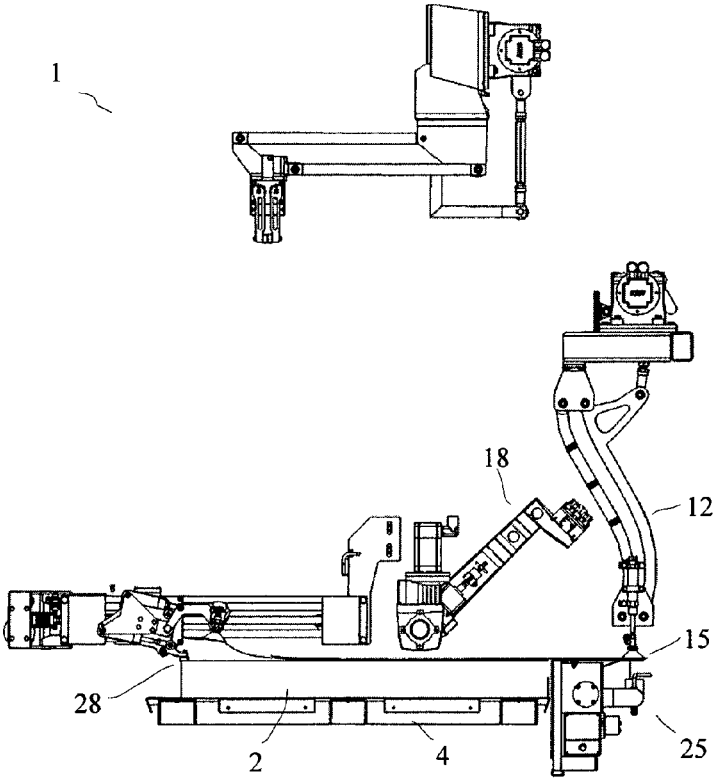
FIG. 8 a sixth view of the processing device according to FIG. 3.
Figure 9:
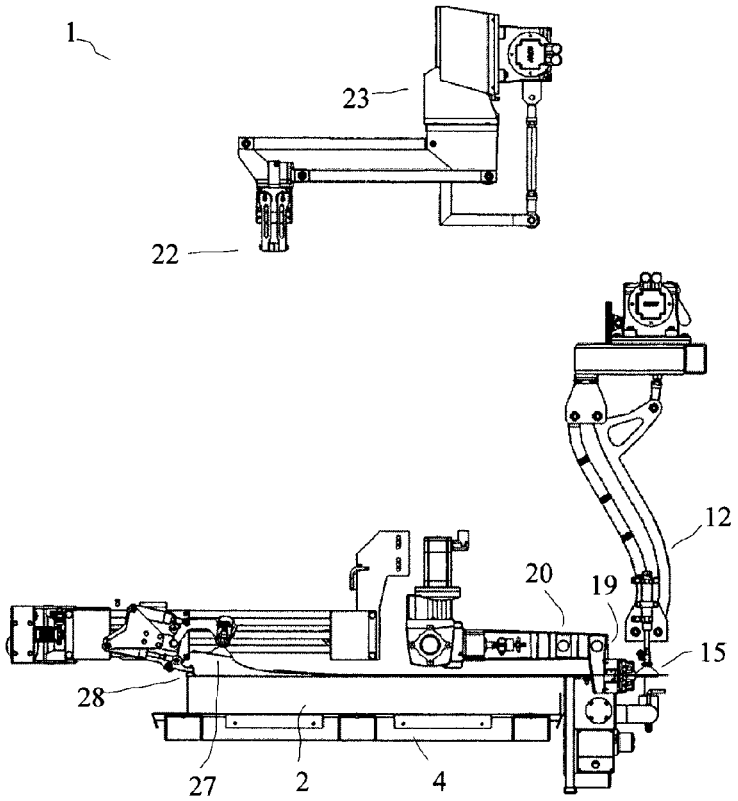
FIG. 9 a seventh view of the processing device according to FIG. 3.

This is the situation illustrated in FIG. 8. At the same time the pivot device 18 pivots from the second pivot position 21 shown previously to a first pivot position 20 illustrated in FIG. 9. In pivoting from the pivot position 21 to the pivot position 20 the gripper device 19 moves from a position noticeably above the stacking device 4 to a position at the level of the stacking device 4 while the gripper device is moved in the longitudinal direction of the open-mouth bags from a central region of the open-mouth bags 3 to the front end.

While the gripper device 19 is pivoting the lifting device 27 with the bag bottom 10 remains lifted and the fixing device 28 lowers down to the bottom area of the remaining stack of bags 2. At the same time the bag conveying device 12 advances some more so as to avoid collision with the pivot device 18. Depending on the configuration it is also possible for the bag conveying device to remain between the two pivot arms of the pivot device 18 as the pivot device pivots downwardly. In the subsequent pivoting motion from the pivot position 20 to the pivot position 21 the bag conveying device 12 at any rate moves out of the path of motion.

Figure 10:
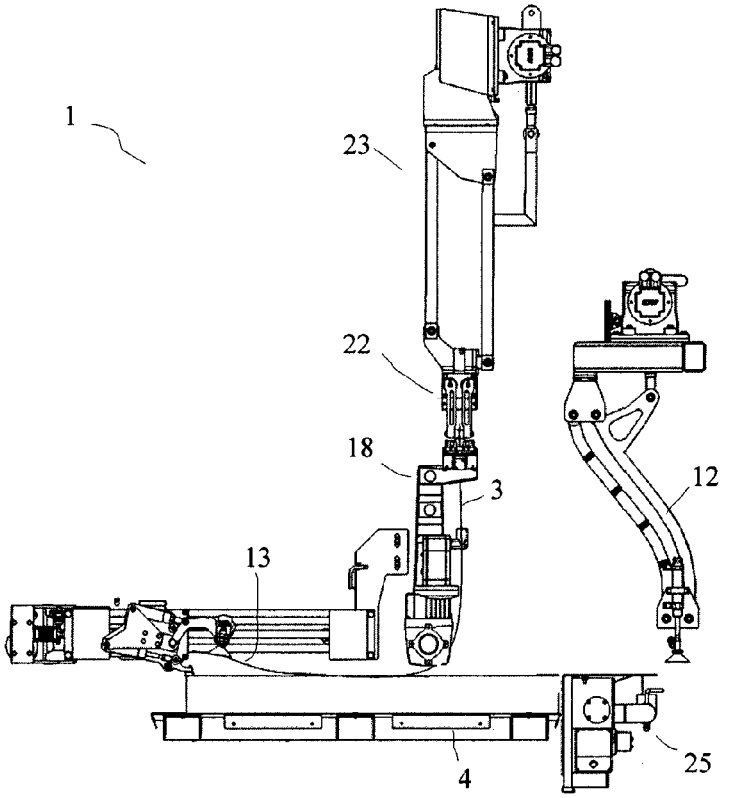
FIG. 10 an eighth view of the processing device according to FIG. 3.

FIG. 10 shows the position in which the pivot device 18 in the upper, second pivot position 21 transfers the open-mouth bag 3 hanging off the gripper device 19 to the bag opener 22 and the bag appending device 23. During pivoting from the pivot position 20 to the pivot position 21 the gripper device 19 moves upwardly and returns, viewed in the longitudinal direction of the open-mouth bags. Thus, in the pivot position 21 the open-mouth bags are hanging in a center area above the stacks of bags 2. The pivoting of the gripper device 19 neither requires more mounting space nor a larger footprint.

Now another open-mouth bag is the topmost open-mouth bag 13 lying on the stack of bags 2. The stacking device 4 automatically lifts such that what is now the topmost open-mouth bag 13 is approximately on the same level as is the supporting device 38 so that the topmost open-mouth bag 13 can later be taken over by the bag conveying device 12.

In the position illustrated in FIG. 10 the bottom end 10 of the open-mouth bag 13 has been lifted and the fixing device 28 has fixed the bottom end of the stack of bags 2. The bag conveying device 12 is in an advanced position in which the pivot device 18 can pivot to the upper, second pivot position 21.

Figure 11:
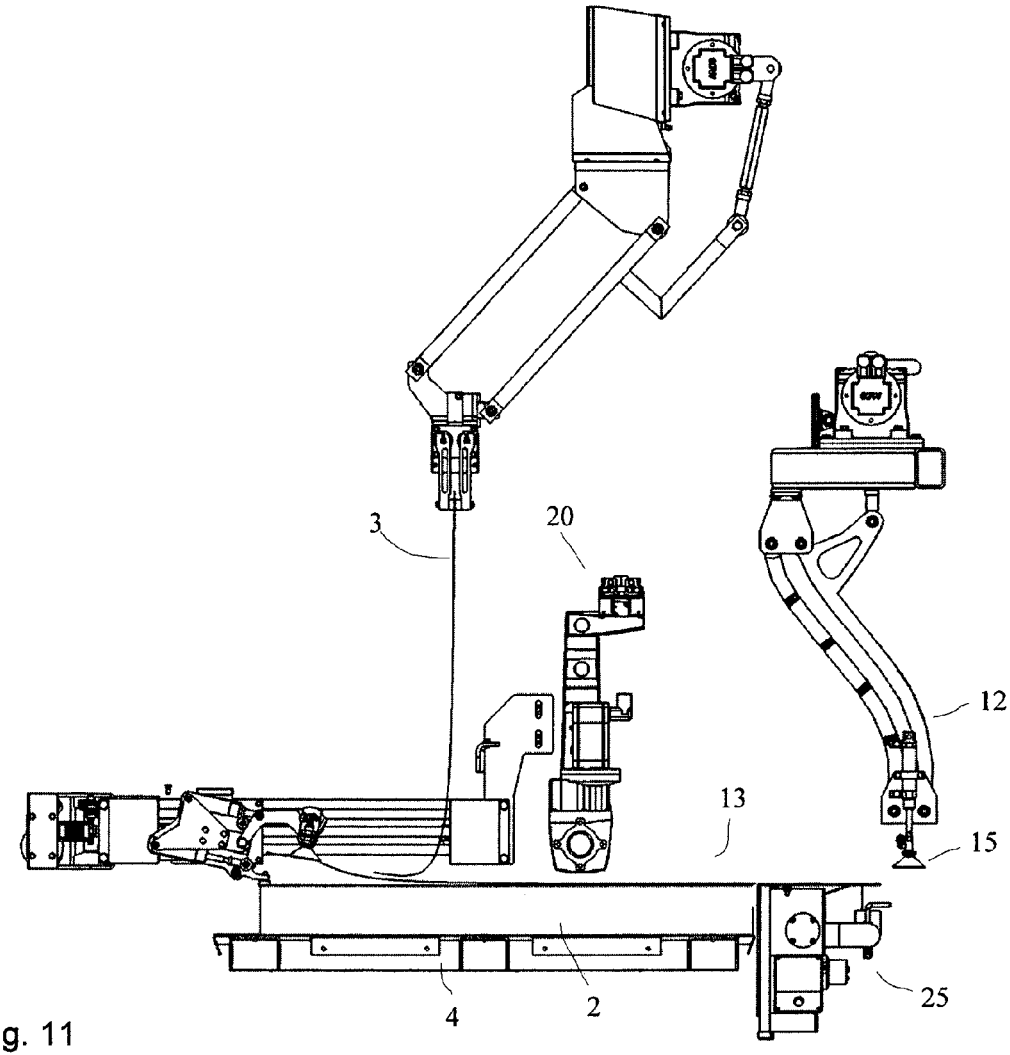
FIG. 11 a ninth view of the processing device according to FIG. 3.

FIG. 11 shows the position after handover of a bag 3 to be filled, from the pivot device 18 to the bag opener 22 and the bag appending device 23. What is now the topmost open-mouth bag 13 is still lifted by its bottom end by the lifting device 27. Thereafter the bag conveying device 12 moves back again such that the suction device 15 grips the open filling mouth 8 of what is now the topmost open-mouth bag 13, lifts it and transfers it to the take-up position 14.

Figure 12:
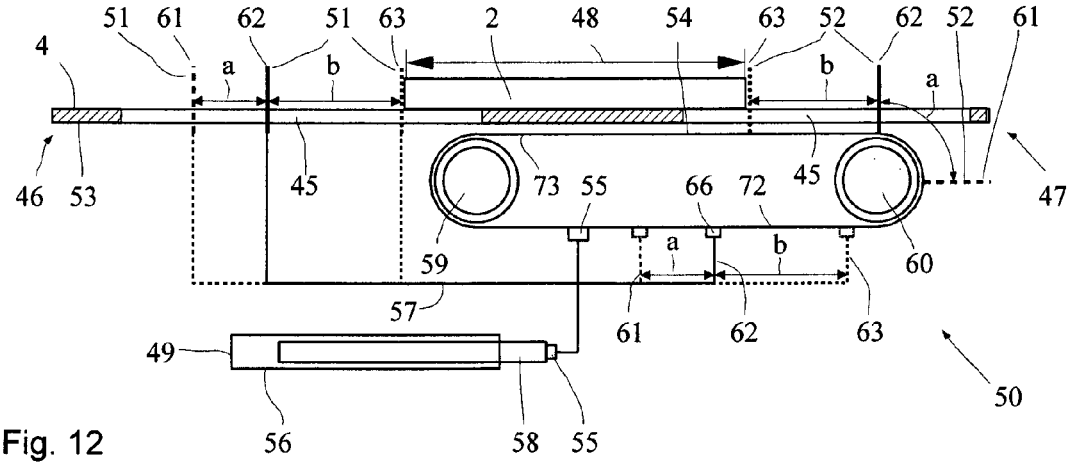
FIG. 12 a side view of a simplistic processing device.

FIG. 12 illustrates a processing device 1 in a simplistic, sectional side view substantially showing the centering device 50 at the schematically illustrated stacking device 4. The centering device 50 is substantially located beneath the stacking device 4 or beneath the plate 53 of the stacking device 4. The plate 53 of the stacking device 4 is illustrated in section. The section is through the region of the grooves 45.

FIG. 12 shows a diagrammatic illustration of a first variant where the centering device 50 of the processing device 1 has a pair of pulleys 59 and 60 around which a continuous belt 54 is provided. The belt 54 which is presently wholly continuous has the centering finger 52 attached to it such that the centering finger 52 protrudes perpendicularly or approximately perpendicularly from the belt 54. This means that as the pulleys 59 and 60 rotate, the centering finger 52 with the belt 54 is conveyed further although it projects perpendicularly from the belt 54.

It is possible for one of the pulleys 59 and 60 to be driven via a motor, presently shown in dashed lines at the pulley 60, provided as the driving device 49 for driving the belt 54. Or else, a cylinder 56 with an extendible piston rod 58 may serve as the driving device 49. The piston rod is firmly connected with the belt 54 via an engaging dog 55. Extending the piston rod 58 therefore causes a synchronous, counterclockwise movement of the belt 54 in the orientation of FIG. 12. Reversely, the belt 54 moves clockwise as the piston rod 58 is retracted.

FIG. 12 shows three different positions 61, 62 and 63 of the centering device 50. The second position 62 is shown in a solid line while the first position 61 and the third position 63 are shown in dotted lines.

In the first position 61 the centering unit 51 configured as a centering finger is on the left side 46, farthest remote from the illustrated stack of bags 2. The centering unit provided on the other side 47 and likewise configured as a centering finger 52 is disposed in the position 61 beneath the plate 53. Since in the position 61 the tine or centering finger 52 is located beneath the plate 53, a new stack of bags 3 can be pushed from the side 47 at least approximately to the base position 5.

As the piston rod 58 extends out of the cylinder 56, the connection point 55 at the belt 54 travels the distance "a" in synchrony, moving toward the pulley 60. In this way the centering finger 51 pivots from the first position 61 beneath the plate 53 through the groove 45 to a position 62 that is at least partially above the plate 53, by the distance "a" and at the same time, during transfer from the first position 61 to the second position 62, the centering finger 51 coupled with the drive belt 54 is transferred by the same distance "a" to the position 62 which is noticeably closer to the stack of bags 2.

As the piston rod 58 extends further out of the cylinder 56 by the distance "b", the centering finger 52 that is coupled with the carrying side 73 travels from the right in the diagram of FIG. 12 toward the stack of bags 2 by the distance "b" while in the illustration according to FIG. 12 the centering finger 51 travels from the left toward the stack of bags by the same distance "b". Finally the extended position is reached in which the third position 63 is reached.

The centering fingers 51 and 52 bear directly against the stack of bags 2. By way of transferring the centering fingers 51 and 52 each of the open-mouth bags 3 inthe stack of bags 2 has been positioned in the third position 63 and centered.

The distance that the piston rod 58 travels and in particular the distance "b" is adapted to the current bag width 48 of the processed open-mouth bags 3.

The centering device 50 allows ease and reliability in centering stacks of bags 2. Moreover, multiple centering units 51 and 52 placed in series one after the other provide a guide when pulling off the open-mouth bags 3. Even if a processed open-mouth bag is briefly entirely released for example in the take-up position 14 before the gripper device 19 grips the top filling mouth 8 of the open-mouth bag 3, the centering device 50 ensures a defined position of the open-mouth bag 3. It has been found that, given high processing speeds and specific bag materials, some open-mouth bags may slightly slip sideways on the stack of bags in the absence of a centering device 50. A centering device 50 equipped with multiple centering units with the centering units positioned in series one after the other will show a reliable and reproducible separation and positioning even of long, narrow open-mouth bags, to then be filled.

With reference to the FIGS. 13 to 15 another exemplary embodiment will be discussed where the centering device 50 is provided with a coupling mechanism 70 to allow temporary decoupling of at least one centering unit 51 from the movement of the continuous belt 54.

The driving device 49 is once again a cylinder 56 with an extendable piston rod 58 or else a driven pulley. An engaging dog 55 is connected with the piston rod 58. The engaging dog 55 is connected with the continuous belt 54.

The engaging dog 55 is provided with a movable stopper 67 provided to move relative to a gliding rod 64 and a coupling rod 57. In this way the movable stopper 67 can be displaced on the gliding rod 64. The relative motion between the gliding rod 64, the coupling rod 57 and the movable stopper 67 is limited by the coupling unit 66 that is configured as a coupling sheet.

Figure 13:
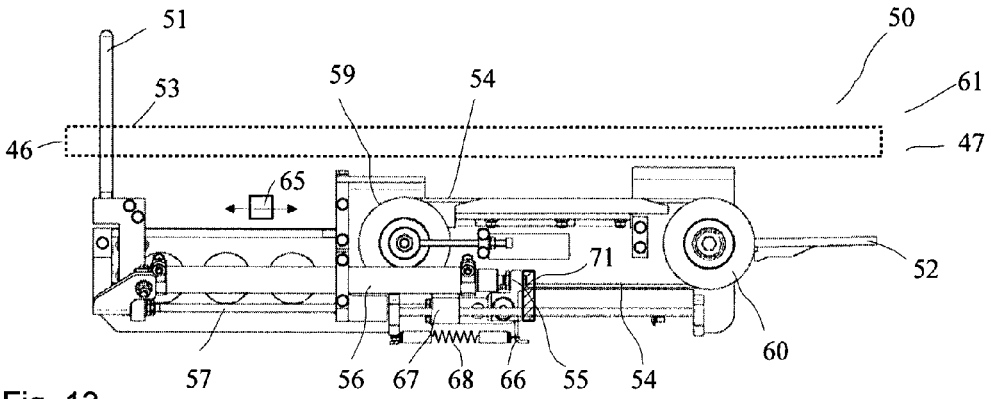
FIG. 13 the centering device of the processing device according to FIG. 2 in a first position.

Firstly, in the first position illustrated in FIG. 13 the coupling between the coupling unit 66 and the movable stopper 67 is released so that as the piston rod 58 extends, the movable stopper 67 fixedly disposed on the engaging dog 55 moves along and glides on the gliding rod 64. Further extending has the movable stopper 67 abut against the coupling unit 66 so that then the coupling rod 57 and the coupling rod 58 will move in synchrony. In this way, as the coupling rod 58 extends further out of the cylinder 56, not only the belt 54 is conveyed but so is the centering unit 51 connected therewith via the coupling rod 57.

While during transfer of the centering unit 52 from the first position 61 (see FIG. 13) to the second position 62 (see FIG. 14), firstly only the centering unit 52 pivots upwardly from the region beneath the plate 53, the first centering unit 51 will also be linearly displaced as the second position 62 is reached. In the case that the first centering unit were fixedly coupled to the belt 54, the first centering unit 51 would already be in the position shown in the hatched area in FIG. 14 after transfer to the second position 62. Then, more mounting width would be required.

Thereafter the centering units 51 and 52 approach one another. Extending of the piston rod 58 out of the cylinder 56 is limited by an adjustable stopper 65 that can be adjusted laterally. When, as the piston rod 58 extends further, the centering unit 51 abuts against the adjustable stopper 65, the piston rod 58 is prohibited from extending further. The position of the adjustable stopper 65 is set such that in this position the centering units 51 and 52 adequately center the stack of bags 2 with the open-mouth bags 3. The position of the adjustable stopper 65 is in particular adapted to the width 48 of the open-mouth bags 3, specifying an intended end position of the centering units 51, 52 offset relative to the center line 69 substantially by half the bag width.

Figure 15:
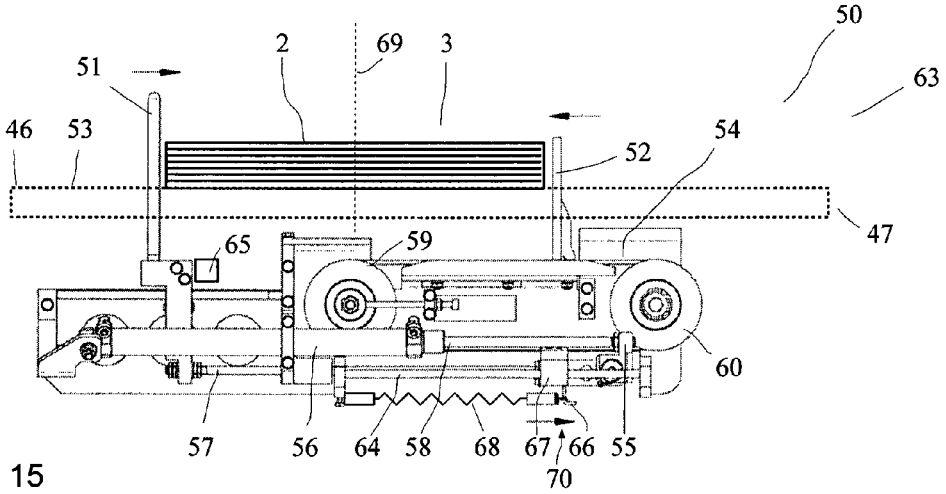
FIG. 15 the centering device of the processing device according to FIG. 2 in a third position.

This position is illustrated in FIG. 15. The coupling device 70 with the presently linked coupling device 66 and the adjustable stopper 65 are coupled to one another. For better understanding FIG. 15 shows on both sides of the stack of bags 2 small distances from the centering fingers 51 and 52 which may, though do not need to, be present when actually centering a stack of bags 3.

As the piston rod 58 retracts back into the cylinder 56, the spring force of the spring device 68 acts, causing a transfer to the first position 61 illustrated in FIG. 13.

Figure 16:
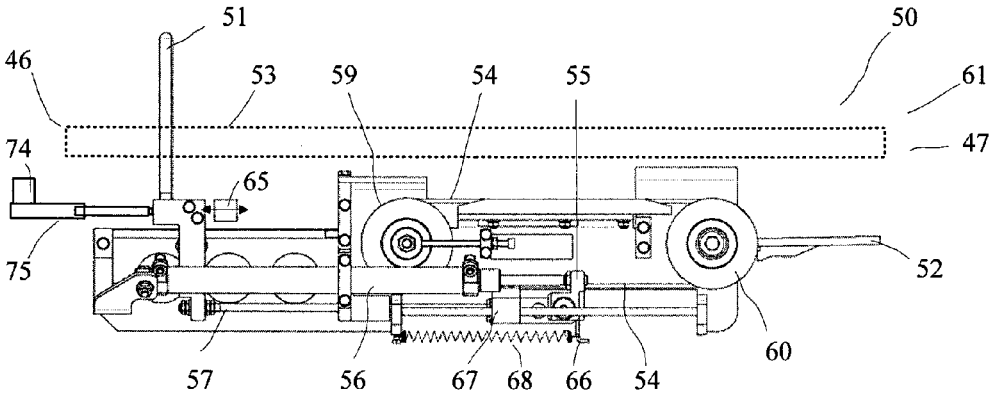
FIG. 16 another centering device for a processing device according to FIG. 2 in a first position.

With reference to the FIGS. 16 and 17 another exemplary embodiment will now be discussed. FIG. 16 is a simplistic view of the processing device 1 with the centering device 50 and the plate 53 of the stacking device. In this configuration the centering device 50 is additionally provided with a driving unit 75 for separately moving the centering unit 51.

An adjustable stopper 65 is again provided that is adjusted to the bag width 48. The adjustable stopper 65 is provided displaceable by way of a driving unit 76. A travel measuring device 74 can capture the position of the adjustable stopper 65 and/or the distance which the centering unit 51 traveled or a measure characteristic thereof. Thus the travel capturing device 74 allows for example computer-controlled adjustment of the bag width 48. In this way the bag width 48 can be set automatically for processing bags of different widths.

Although such a travel capturing device is not shown in the preceding exemplary embodiments, it is preferably provided therein.

In the embodiment variant illustrated in FIG. 16 the centering unit 51 is positioned at the stopper 65 immediately above the driving unit 75. This means that the centering unit 51 is directly transferred to its end position which corresponds to the position 63 in the preceding example according to FIG. 14. The centering unit 52, however, remains in the first position 61 beneath the plate 53.

Now when the stack of bags 2 is intended to be centered, the piston rod 58 of the cylinder 56 is extended. The belt 54 is conveyed immediately further and the centering unit 52 pivots upwardly around the pulley 60 and through the groove 45 in the plate 53.

Thereafter the centering unit 52 travels toward the first centering unit 51 as the cylinder 58 extends further until the third position 63 and thus the end position is reached.

Figure 17:
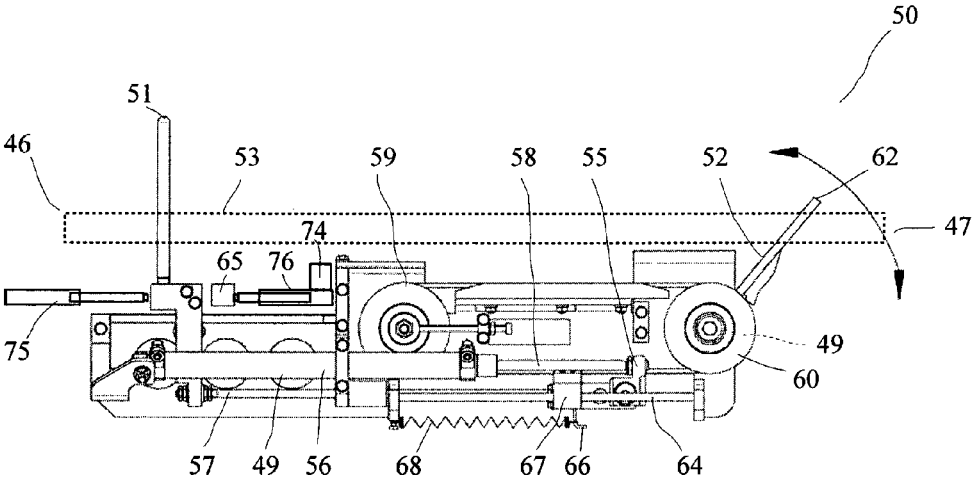
FIG. 17 the centering device according to FIG. 16 in a second position.

FIG. 17 shows the intermediate position of the centering unit 52 in the second position 62. In the third position 63 a position will result as it has been illustrated in FIG. 15 and discussed with reference to the preceding exemplary embodiment.

On the whole the invention provides an advantageous processing device that allows reliable centering and/or separating of the bags.

Figure 14:
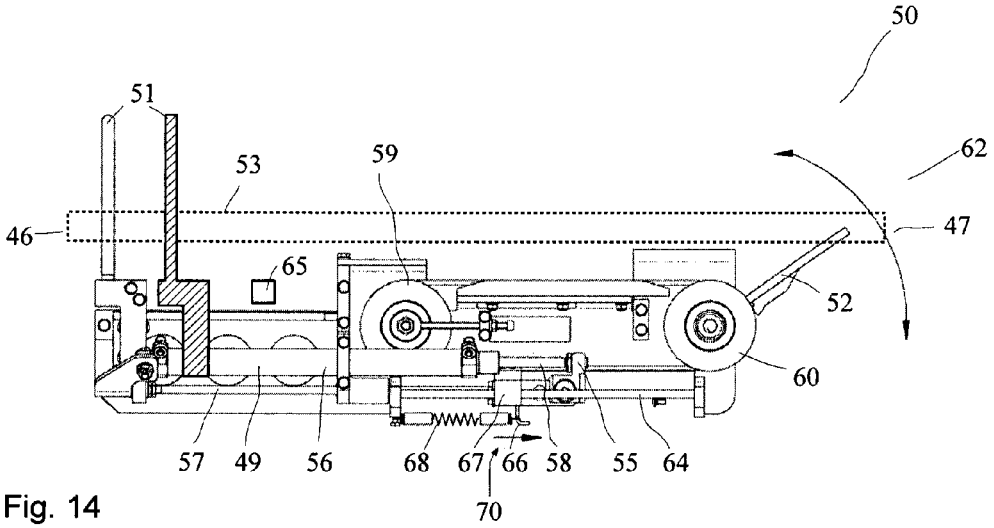
FIG. 14 the centering device of the processing device according to FIG. 2 in a second position.

The centering device according to FIGS. 13 to 15 allows centering and reliably positioning a stack of bags 2, with the centering units 51 and 52 approaching the stack of bags 2 from both sides 46 and 47. In the exemplary embodiment according to FIGS. 16 and 17 the stack of bags is positioned at an end stopper which is formed by the centering units 51. For the further centering the centering units 52 approach the stack of bags 2 from the other side 47.

In the further processing and separating the open-mouth bags 3 are guided by the centering units 51 and 52 in an advantageous way so as to reliably prevent the open-mouth bags 3 from slipping sideways during pulling forward and in the further processing.

On the whole the invention provides an advantageous processing device and an advantageous method which allow to reliably and efficiently separate open-mouth bags from a stack of bags. The required footprint and also the space requirement are low. The output can be considerably increased over the prior art thus resulting in advantages of both mounting space and capacity. In the take-up position, marks and other applications can be applied on the open-mouth bag.

The processing device 1 can be controlled by a control device, not shown, provided with one or more light barrier (s) or other sensors to ensure defined positioning during the entire operation.

The compact design allows noticeably reduced space requirements so as to allow considerably increased bagging capacities within the same mounting space.

| List of reference numerals: | |
|---|---|
| 1 | processing device |
| 2 | stack of bags |
| 3 | open-mouth bag |
| 4 | stacking device |
| 5 | base position |
| 6 | bag length |
| 7 | mark |
| 8 | open filling mouth |
| 9 | one end |
| 10 | bottom, bag bottom |
| 11 | other end |
| 12 | bag conveying device |
| 13 | topmost open-mouth bag |
| 14 | take-up position |
| 15 | suction device |
| 16 | distance |
| 17 | pivot axis |
| 18 | pivot device |
| 19 | gripper device |
| 20 | first pivot position |
| 21 | second pivot position |
| 22 | bag opener |
| 23 | bag appending device |
| 24 | pivot axis |
| 25 | marker device |
| 26 | bulk material |
| 27 | lifting device |
| 28 | fixing device |
| 29 | product feeder |
| 30 | filling spout |
| 31 | closing device |
| 32 | discharge device |
| 33 | bag stacking magazine |
| 34 | casing |
| 35 | silo |
| 36 | dosing and weighing device |
| 37 | cylinder device |
| 38 | supporting device |
| 40 | adjustment device |
| 41 | upper conveying device |
| 42 | designation |
| 43 | Date |
| 44 | marking area |
| 45 | groove |
| 46 | side |
| 47 | side |
| 48 | bag width |
| 49 | driving device |
| 50 | centering device |
| 51 | centering unit, centering finger |
| 52 | centering unit, centering finger |

-continued

| List of reference numerals: | |
|---|---|
| 53 | plate |
| 54 | belt |
| 55 | engaging dog |
| 56 | cylinder |
| 57 | coupling rod |
| 58 | piston rod |
| 59 | pulley |
| 60 | pulley |
| 61 | first position |
| 62 | second position |
| 63 | third position |
| 64 | gliding rod |
| 65 | adjustable stopper |
| 66 | coupling unit, coupling sheet |
| 67 | movable stopper |
| 68 | spring device |
| 69 | center line |
| 70 | coupling mechanism |
| 72 | return side |
| 73 | carrying side |
| 74 | travel capturing device |
| 75 | driving unit |
| 76 | driving unit |
| 100 | packaging machine |

The invention claimed is:

1. A processing device for processing at least one stack of bags comprising a plurality of bags wherein at least one stacking device is provided on which the stack of bags can be arranged in a base position wherein the bags in the stack of bags have a bag length and a bag width, comprising:

at least one centering device is provided comprising at least two centering units disposed opposite one another and disposed so that a driving device can move them relative to one another, towards one another and away from one another, and that the centering unit provided on a first side is at least temporarily coupled with a return side of at least one continuous belt, and wherein the centering unit provided on a second side is at least temporarily coupled with the carrying side of at least one continuous belt, wherein at least one of said at least two centering units is provided in a first position beneath a plate of the stacking device.

2. The processing device according to claim 1 wherein the driving device drives at least one continuous belt, and wherein at least one of said at least two centering units is at least temporarily coupled to the at least one continuous belt.

3. The processing device according to claim 1 wherein at least part of the centering units disposed on two opposite sides is at least temporarily coupled with said at least one continuous belt of the driving device.

4. The processing device according to claim 1 wherein at least one of said at least two centering units is configured as a centering finger.

5. The processing device according to claim 1 wherein at least one of said at least two centering units is at least temporarily displaceably disposed in a groove of the stacking device.

6. The processing device according to claim 1 wherein at least one of said at least two centering units extend in a second position through the groove beyond the top surface of the plate of the stacking device.

7. The processing device according to claim 1 wherein an adjustable stopper is provided that defines a bag width.

8. The processing device according to claim 7 wherein the adjustable stopper is provided displaceable and wherein a travel capturing device is assigned to the adjustable stopper to allow automatically controlled adjustment of the bag width.

9. The processing device according to claim 1 wherein each centering unit is coupled to the at least one continuous belt by means of a coupling mechanism.

10. The processing device according to claim 9 wherein the coupling mechanism comprises a spring device.

11. The processing device according to claim 9 wherein the coupling mechanism comprises at least one coupling unit and at least one movable stopper.

12. The processing device according to claim 9 wherein the coupling mechanism is configured and set up for establishing at least in a second position and/or a third position, a coupling between the centering units and the at least one continuous belt.

13. The processing device according to claim 12 wherein the coupling mechanism is configured and set up so that in the first position a coupling between at least one of the at least two centering units and the at least one continuous belt is released.

14. The processing device according to claim 1 wherein a separate driving unit is provided for displacing the at least one of said at least two centering units on one side.

15. A processing device for processing at least one stack of bags comprising a plurality of bags wherein at least one stacking device is provided on which the stack of bags can be arranged in a base position wherein the bags in the stack of bags have a bag length and a bag width, comprising:

at least one centering device is provided comprising at least two centering units disposed opposite one another and disposed so that a driving device can move them relative to one another, towards one another and away from one another, and that the centering unit provided on a first side is at least temporarily coupled with a return side of at least one continuous belt, and wherein the centering unit provided on a second side is at least temporarily coupled with the carrying side of at least one continuous belt; and an adjustable stopper that defines a bag width, wherein the adjustable stopper is displaceable; and a travel capturing device associated with the adjustable stopper that is configured to automatically control adjustment of the bag width.

16. A processing device for processing at least one stack of bags comprising a plurality of bags wherein at least one stacking device is provided on which the stack of bags can be arranged in a base position wherein the bags in the stack of bags have a bag length and a bag width, comprising:

at least one centering device is provided comprising at least two centering units disposed opposite one another and disposed so that a driving device can move them relative to one another, towards one another and away from one another, and that the centering unit provided on a first side is at least temporarily coupled with a return side of at least one continuous belt, and wherein the centering unit provided on a second side is at least temporarily coupled with the carrying side of at least one continuous belt, wherein each centering unit is coupled to the at least one continuous belt by means of a coupling mechanism comprising a spring device.

* * * * *